US009784085B2

(12) United States Patent
Liu et al.

(10) Patent No.: US 9,784,085 B2
(45) Date of Patent: Oct. 10, 2017

(54) METHOD FOR TRANSVERSE FRACTURING OF A SUBTERRANEAN FORMATION

(75) Inventors: Hai Liu, Beijing (CN); Bernard Andre Montaron, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 831 days.

(21) Appl. No.: 14/005,178

(22) PCT Filed: Sep. 10, 2012

(86) PCT No.: PCT/CN2012/081211

§ 371 (c)(1),
(2), (4) Date: Sep. 13, 2013

(87) PCT Pub. No.: WO2014/036742

PCT Pub. Date: Mar. 13, 2014

(65) Prior Publication Data

US 2014/0069653 A1 Mar. 13, 2014

(51) Int. Cl.
*E21B 43/26* (2006.01)
*E21B 49/00* (2006.01)

(52) U.S. Cl.
CPC ..... *E21B 43/26* (2013.01); *E21B 49/006* (2013.01)

(58) Field of Classification Search
CPC ..... E21B 43/26; E21B 49/006; E21B 43/267; E21B 43/114; E21B 43/305; E21B 43/119; E21B 43/162
See application file for complete search history.

(56) References Cited

U.S. PATENT DOCUMENTS 4,850,431 A 7/1989 Austin et al.
4,974,675 A 12/1990 Austin et al.
(Continued)

FOREIGN PATENT DOCUMENTS

CA 2596201 C 2/2010
EP 644316 A2 3/1995
(Continued)

OTHER PUBLICATIONS

Jet Edge, "Waterjet Success Stories Case Studies," [online], [retrieved on Jan. 4, 2012], Retrieved from the Internet<URL: http://jetedge.com/content.cfm?fuseaction=dsp_success_case &case_ID=92>.
(Continued)

*Primary Examiner* — Daniel P Stephenson
(74) *Attorney, Agent, or Firm* — Michael L. Flynn; Tim Curington

(57) ABSTRACT

Techniques for fracturing a subterranean formation penetrated by a wellbore are provided. The subterranean formation has vertical and horizontal stresses applied thereto. The wellbore has a near wellbore stress zone thereabout. The method involves drilling the wellbore along a drilling path (the wellbore having a vertical portion and a horizontal portion), creating at least one 360-degree perforation in the subterranean formation about the horizontal portions of the wellbore, and fracturing the formation by injecting a fluid into the 360-degree perforations. The 360-degree perforations extend about the wellbore a distance beyond the near wellbore stress zone and at least twice a diameter of the wellbore starting from an axis of the wellbore. A direction of the 360-degree perforation is transverse to the wellbore axis.

21 Claims, 9 Drawing Sheets

(56) References Cited

U.S. PATENT DOCUMENTS

| | | | | |
|---|---|---|---|---|
| 4,977,961 | A | 12/1990 | Avasthi | |
| 5,249,628 | A | 10/1993 | Surjaatmadja | |
| 5,325,923 | A | 7/1994 | Surjaatmadja et al. | |
| 5,335,724 | A | 8/1994 | Venditto et al. | |
| 5,361,856 | A | 11/1994 | Surjaatmadja et al. | |
| 5,381,631 | A | 1/1995 | Raghavan et al. | |
| 5,396,957 | A | 3/1995 | Surjaatmadja et al. | |
| 5,445,220 | A | 8/1995 | Gurevich et al. | |
| 5,482,116 | A * | 1/1996 | El-Rabaa | E21B 43/26 166/250.1 |
| 5,494,103 | A | 2/1996 | Surjaatmadja et al. | |
| 6,286,599 | B1 | 9/2001 | Surjaatmadja et al. | |
| 6,351,991 | B1 | 3/2002 | Sinha | |
| 6,394,184 | B2 | 5/2002 | Tolman et al. | |
| 6,543,538 | B2 | 4/2003 | Tolman et al. | |
| 6,564,868 | B1 | 5/2003 | Ferguson et al. | |
| 6,904,365 | B2 | 6/2005 | Bratton et al. | |
| 7,032,671 | B2 * | 4/2006 | Aud | E21B 43/26 166/250.1 |
| 7,096,954 | B2 | 8/2006 | Weng et al. | |
| 7,357,182 | B2 | 4/2008 | Hunt et al. | |
| 7,413,010 | B2 * | 8/2008 | Blauch | E21B 43/003 166/249 |
| 7,434,633 | B2 | 10/2008 | Lynde et al. | |
| 7,527,092 | B2 | 5/2009 | McAfee | |
| 7,546,876 | B2 | 6/2009 | McAfee | |
| 7,571,766 | B2 * | 8/2009 | Pauls | C09K 8/68 166/280.1 |
| 7,640,982 | B2 * | 1/2010 | Schultz | E21B 43/261 166/250.1 |
| 7,644,761 | B1 * | 1/2010 | Gu | E21B 43/267 166/280.1 |
| 7,788,037 | B2 * | 8/2010 | Soliman | E21B 49/00 702/12 |
| 7,828,063 | B2 | 11/2010 | Olsen et al. | |
| 7,848,895 | B2 * | 12/2010 | Zoback | E21B 43/26 166/250.1 |
| 7,882,745 | B2 | 2/2011 | Huang et al. | |
| 8,126,646 | B2 * | 2/2012 | Grove | E21B 43/119 175/50 |
| 8,126,689 | B2 * | 2/2012 | Soliman | E21B 43/26 703/10 |
| 8,439,116 | B2 * | 5/2013 | East, Jr. | E21B 43/305 166/250.1 |
| 8,770,316 | B2 | 7/2014 | Jelsma | |
| 8,887,803 | B2 * | 11/2014 | East, Jr. | E21B 34/14 166/250.1 |
| 9,297,250 | B2 * | 3/2016 | Dusterhoft | E21B 43/26 |
| 2004/0206733 | A1 | 10/2004 | Hillebrand et al. | |
| 2008/0166132 | A1 | 7/2008 | Lynde et al. | |
| 2009/0045176 | A1 | 2/2009 | Wawers et al. | |
| 2009/0065252 | A1 * | 3/2009 | Moos | E21B 7/06 175/50 |
| 2009/0109794 | A1 | 4/2009 | Sinha | |
| 2009/0125240 | A1 | 5/2009 | den Boer et al. | |
| 2009/0288833 | A1 | 11/2009 | Graham et al. | |
| 2009/0288834 | A1 | 11/2009 | Jelsma | |
| 2010/0250214 | A1 | 9/2010 | Prioul et al. | |
| 2011/0017458 | A1 * | 1/2011 | East, Jr. | E21B 43/26 166/308.1 |
| 2011/0198087 | A1 | 8/2011 | Adam | |
| 2011/0209868 | A1 | 9/2011 | Dusterhoft et al. | |
| 2011/0247815 | A1 | 10/2011 | Jelsma | |
| 2012/0217019 | A1 | 8/2012 | Zediker et al. | |
| 2013/0008659 | A1 | 1/2013 | Schultz et al. | |
| 2013/0032349 | A1 * | 2/2013 | Alekseenko | E21B 43/26 166/308.1 |
| 2013/0220604 | A1 * | 8/2013 | El-Rabaa | E21B 49/006 166/259 |
| 2014/0069653 | A1 * | 3/2014 | Liu | E21B 43/26 166/308.1 |
| 2014/0222405 | A1 * | 8/2014 | Lecerf | G06G 7/50 703/10 |
| 2014/0278316 | A1 * | 9/2014 | Dusterhoft | E21B 43/26 703/10 |
| 2015/0129211 | A1 * | 5/2015 | Dusseault | E21B 43/267 166/280.1 |
| 2015/0176400 | A1 * | 6/2015 | Kulathu | E21B 43/26 703/10 |
| 2016/0108705 | A1 * | 4/2016 | Maxwell | E21B 43/267 166/250.1 |

FOREIGN PATENT DOCUMENTS

| | | | |
|---|---|---|---|
| WO | WO0161146 | A1 | 8/2001 |
| WO | WO0206629 | A1 | 1/2002 |
| WO | WO2004009956 | | 1/2004 |
| WO | WO2009096805 | | 8/2009 |
| WO | WO2011148315 | A2 | 12/2011 |
| WO | 2012031009 | A1 | 3/2012 |

OTHER PUBLICATIONS

Hslao, C., "A Study of Horizontal Wellbore Failure," SPE16927, SPE Production Engineering, Nov. 1988, pp. 489-494.

Yew et al., "Fracturing of a Deviated Well," SPE 16930, SPE Production Engineering, Nov. 1988, pp. 429-437.

Rabaa, W. El, "Experimental Study of Hydraulic Fracture Geometry Initiated From Horizontal Wells," SPE 19720, presented at the 64th Annual Technical Conference and Exhibition of the Society of Petroleum Engineers, San Antonio, Texas, Oct. 8-11, 1989, pp. 189-204.

Hossain et al., "A Comprehensive Monograph for Hydraulic Fracture Initiation From Deviated Wellbores Under Arbitrary Stress Regimes," SPE 54360, presented at the 1999 SPE Asia Pacific Oil and Gas Conference and Exhibition, Jakarta, Indonesia, Apr. 20-22, 1999, pp. 1-11.

Waters, et al., "Use of Horizontal Well Image Tools to Optimize Barnett Shale Reservoir Exploitation," SPE 103202, presented at the 2006 SPE Annual Technical Conference and Exhibition, San Antonio, Texas, Sep. 24-27, 2006, pp. 1-13.

Economides M.J. and Nolte K.G., Reservoir Stimulation, John Wiley and Sons, Ltd, 3rd Edition New York, 2000, Chapter 3, "Formation Characterization: Rock Mechanics," by M.C. Thiercelin and J.-C. Roegiers, (pp. 3-1 to 3-35).

Economides M.J. and Nolte K.G., Reservoir Stimulation, John Wiley and Sons, Ltd, 3rd Edition New York, 2000—Chapter 5, "Basics of Hydraulic Fracturing" by M.B.Smith and J.W. Shlyapobersky, (pp. 5-1 to 5-28).

Economides M.J. and Nolte K.G., Reservoir Stimulation, John Wiley and Sons, Ltd, 3rd Edition New York, 2000—Chapter 7, "Fracturing Fluid Chemistry and Proppants" by Janet Gulbis and Richard M.Hogde, (pp. 7-1 to 7-23).

Journal of Petroleum Science and Engineering, 2 (1989) 349-360—Stresses Around Horizontal Boreholes Drilled in Sedimentary Rocks.

International Search Report and Written Opinion issued for International Patent Application No. PCT/CN2012/081211 on Jun. 13, 2013, 11 pages.

International Search Report and Written Opinion issued in International Patent Application No. PCT/US2014/070121 dated Mar. 25, 2015; 10 pages.

* cited by examiner

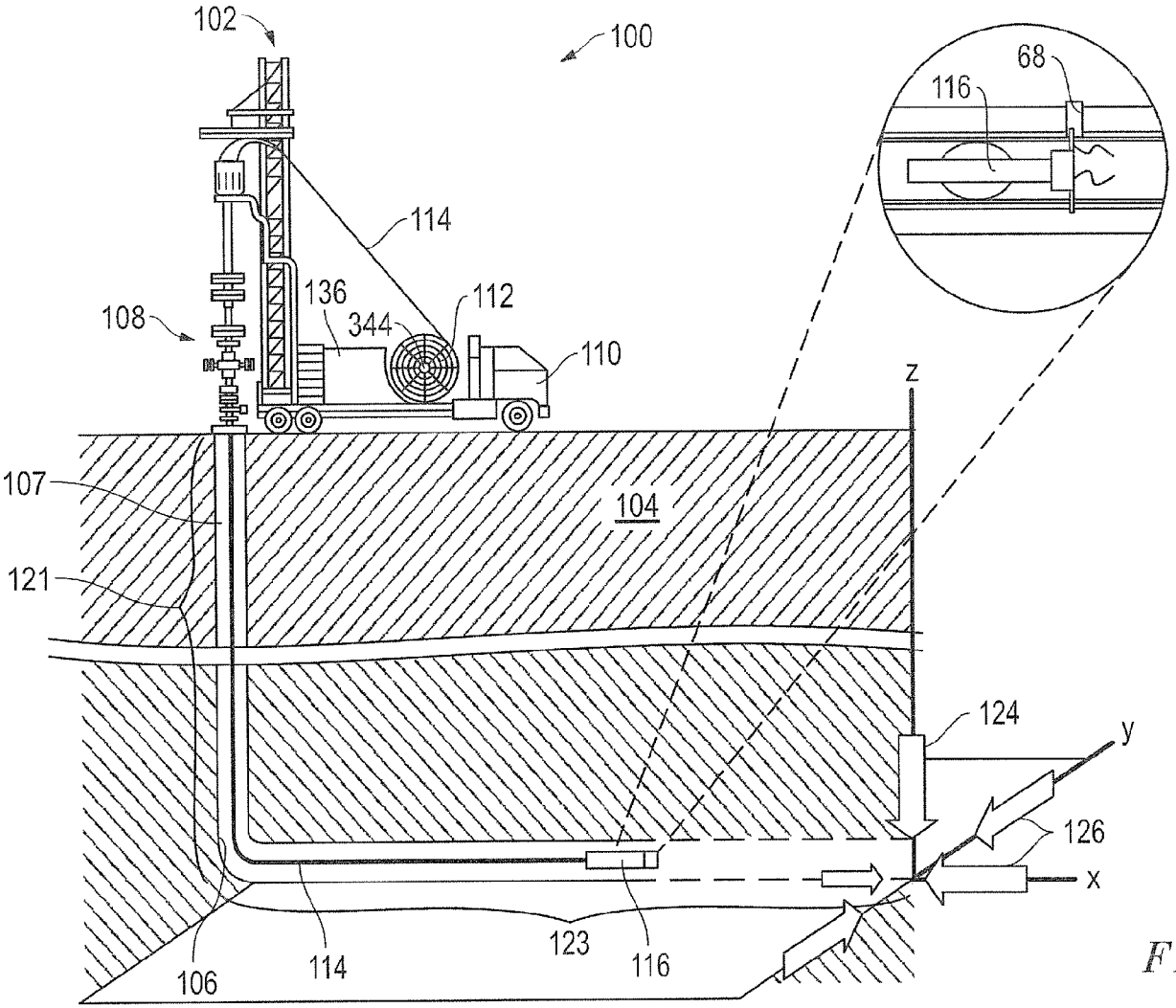
FIG. 1.1

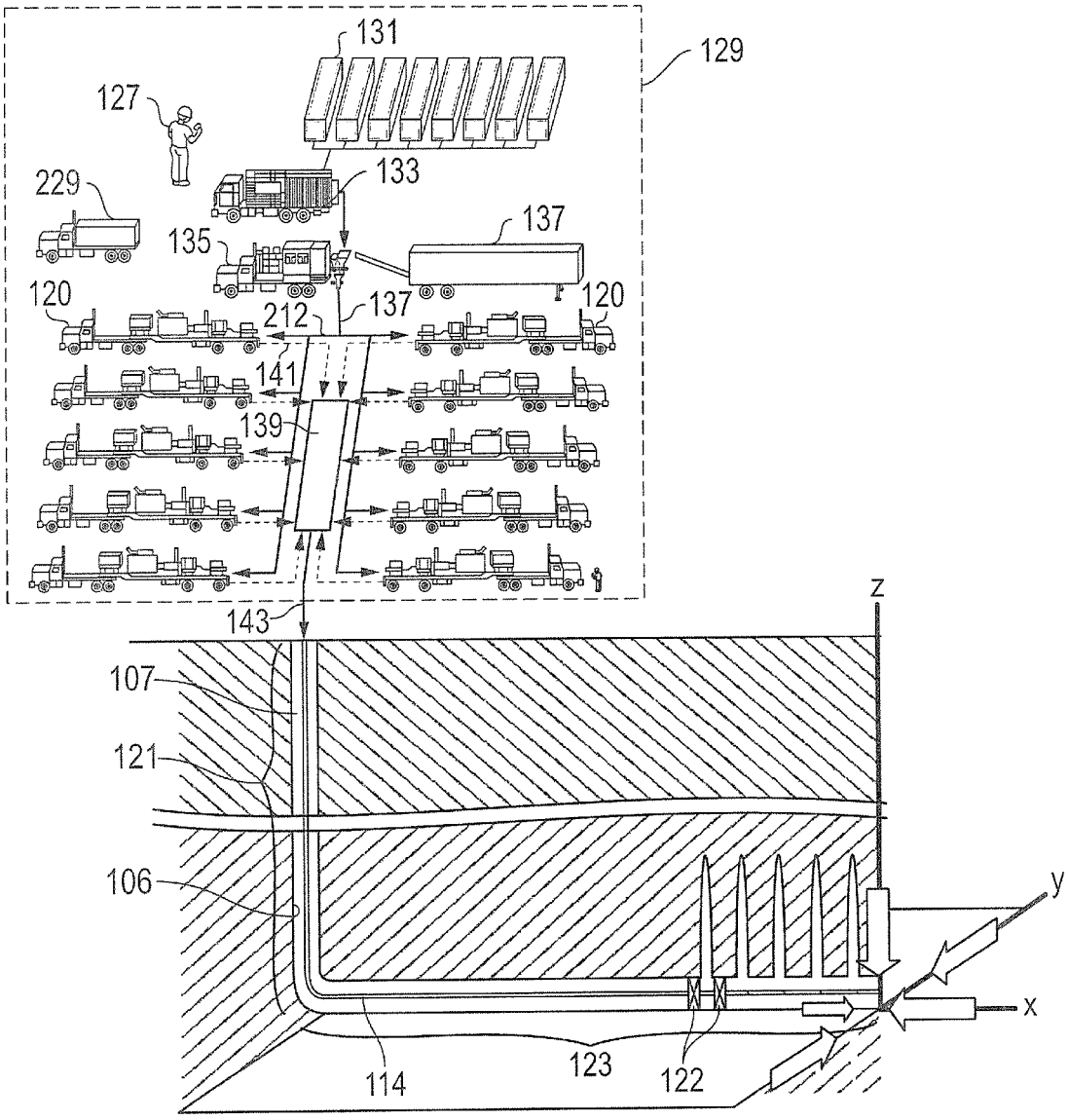
*FIG. 1.2*

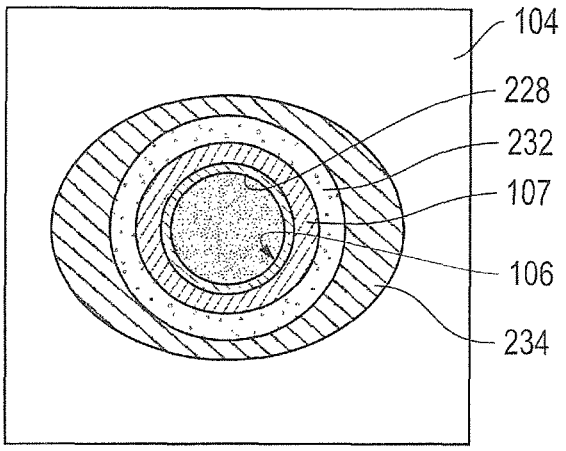
FIG. 2.1
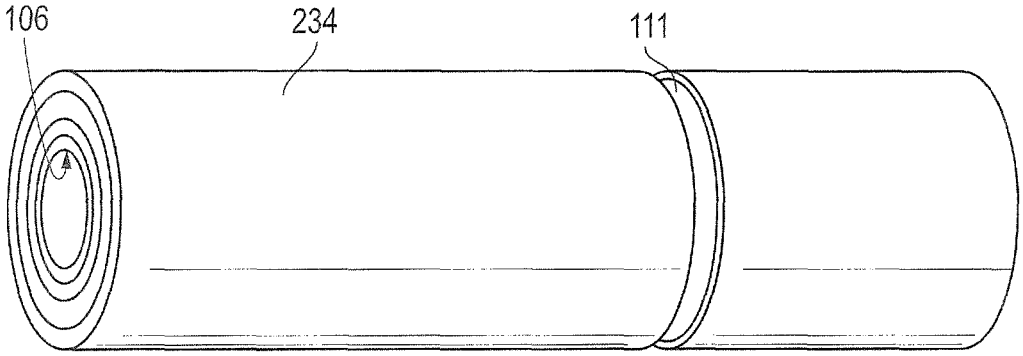
FIG. 2.2
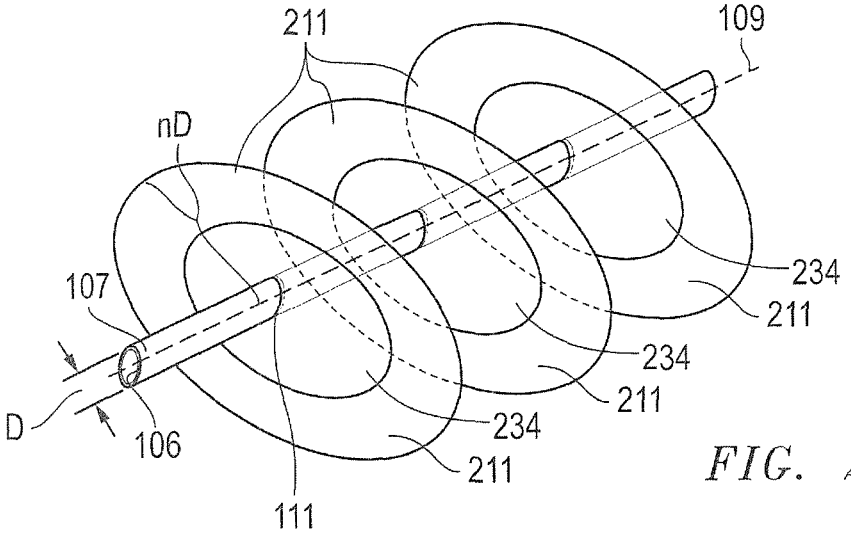
FIG. 2.3

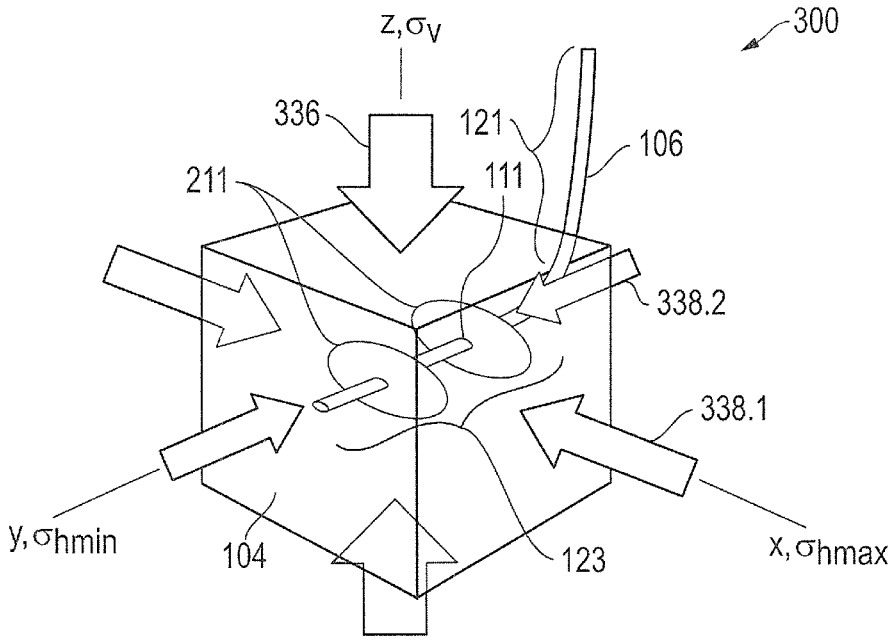
*FIG. 3*
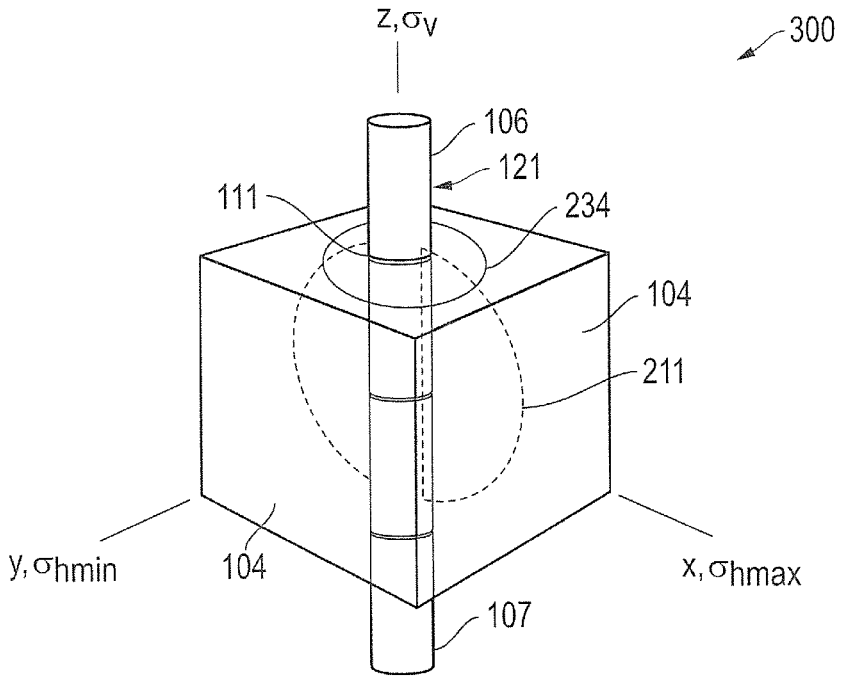
*FIG. 4.1*

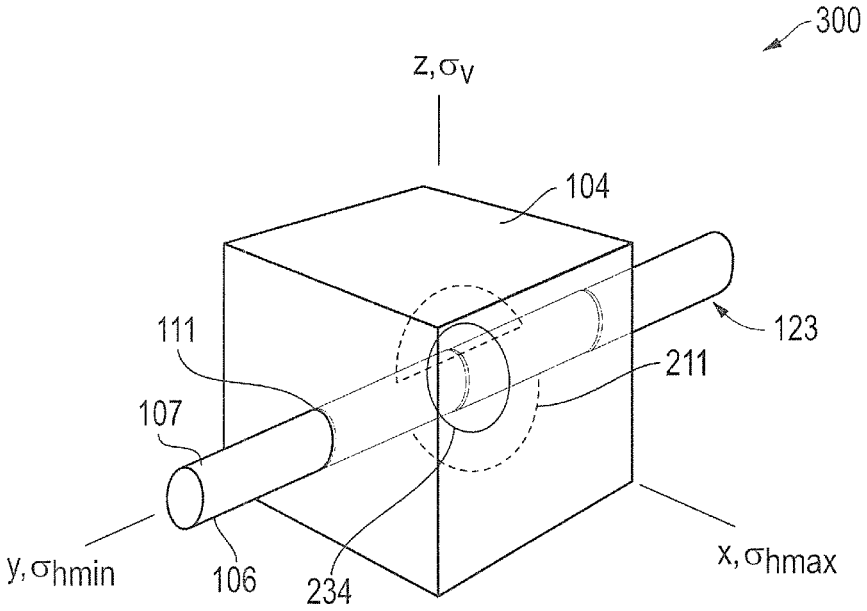
*FIG. 4.2*
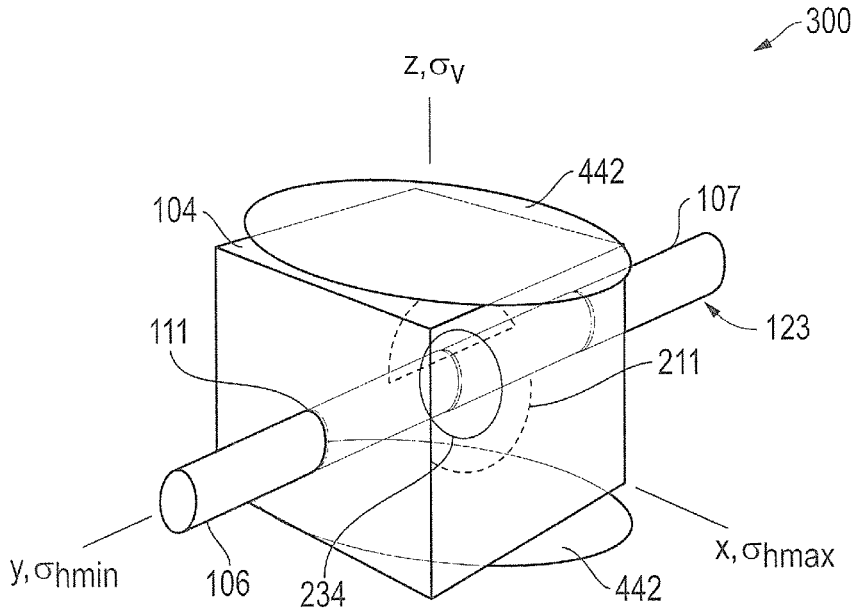
*FIG. 4.3*

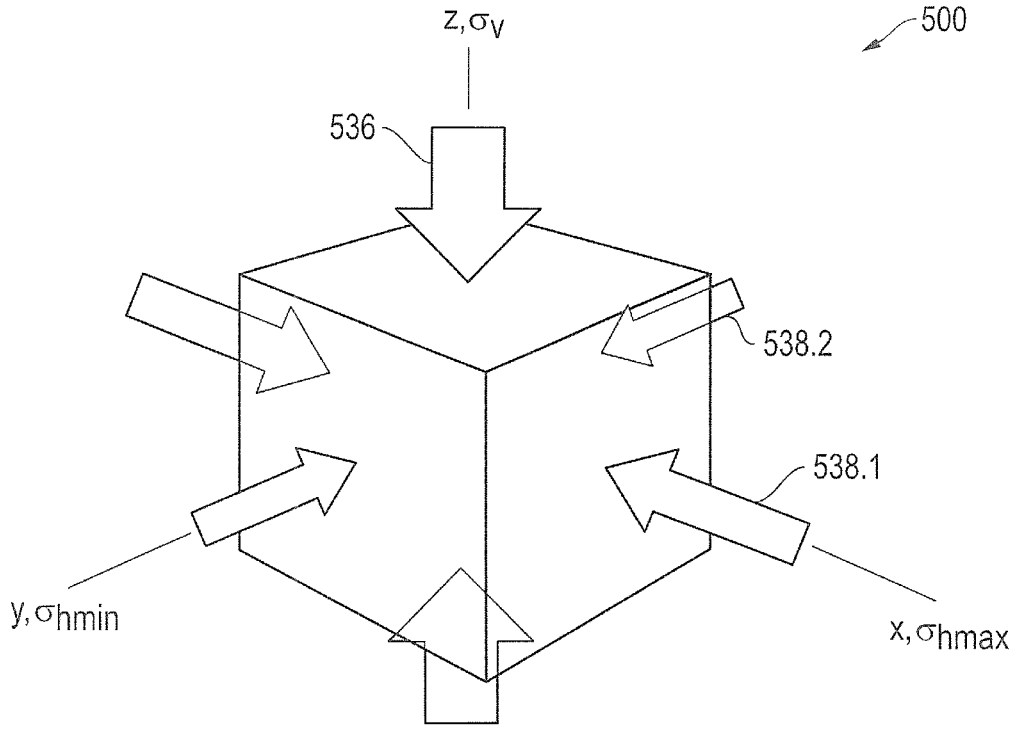
*FIG. 5*
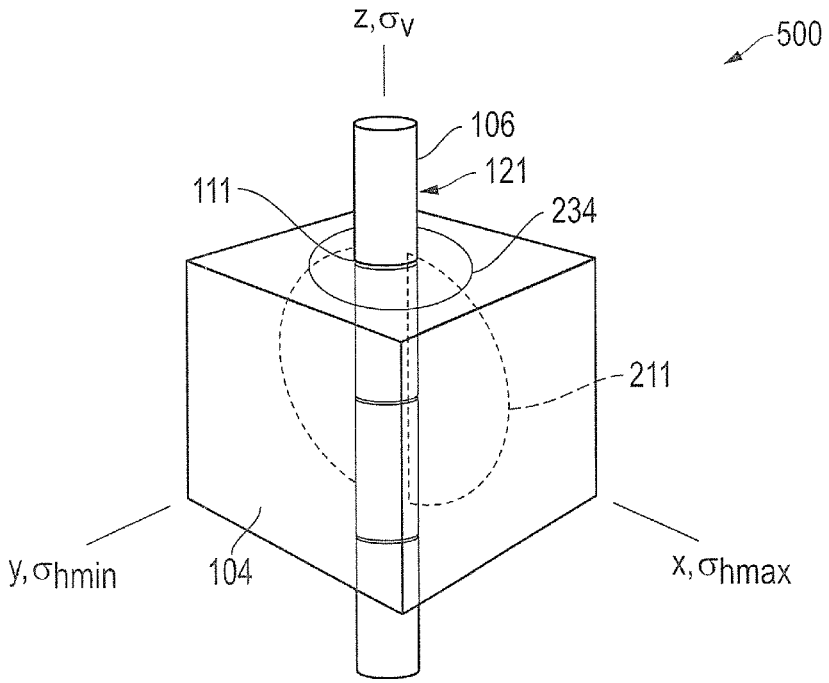
*FIG. 6.1*

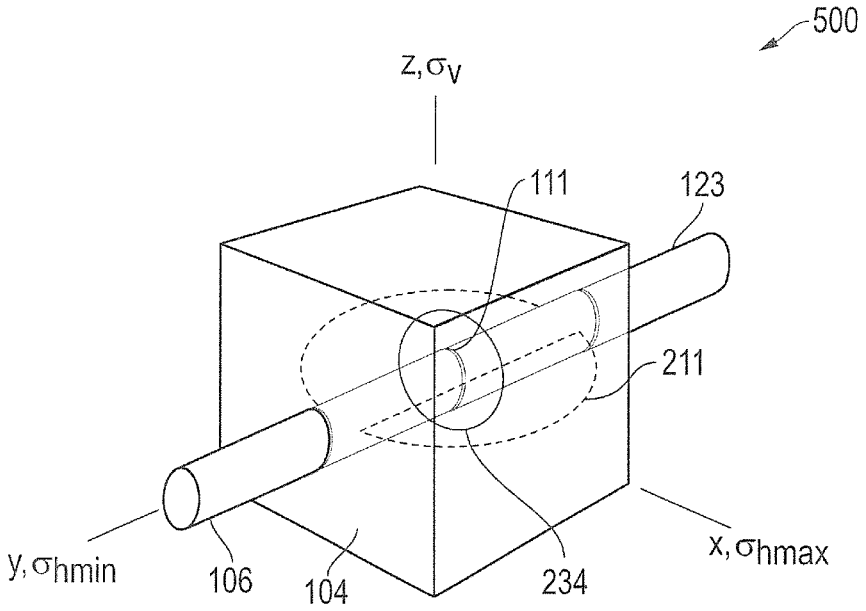
*FIG. 6.2*
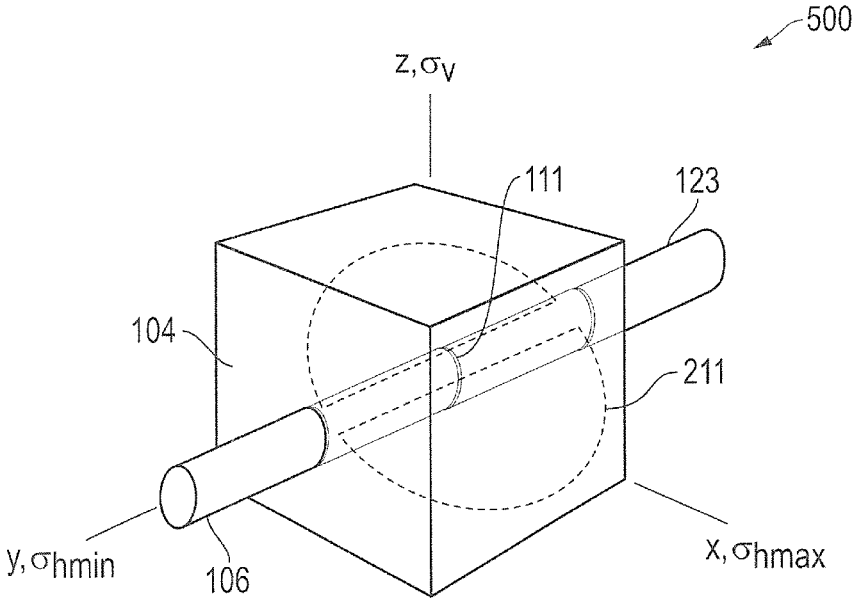
*FIG. 6.3*

METHOD FOR TRANSVERSE FRACTURING OF A SUBTERRANEAN FORMATION

BACKGROUND

The present disclosure relates to techniques for performing oilfield operations. More particularly, the present disclosure relates to techniques for performing wellbore stimulation operations, such as perforating, injecting, treating, and/or fracturing subterranean formations.

Oilfield operations may be performed to locate and gather valuable downhole fluids, such as hydrocarbons. Oilfield operations may include, for example, surveying, drilling, downhole evaluation, completion, production, stimulation, and oilfield analysis. Surveying may involve seismic surveying using, for example, a seismic truck to send and receive downhole signals.

Drilling may involve advancing a downhole tool into the earth to form a wellbore. The wellbore may be drilled along a vertical, angled or horizontal path. Downhole evaluation may involve deploying a downhole tool into the wellbore to take downhole measurements and/or to retrieve downhole samples. Completion may involve cementing and casing a wellbore in preparation for production. Production may involve deploying production tubing into the wellbore for transporting fluids from a reservoir to the surface.

Wells may be drilled along a desired trajectory to reach subsurface formations. The trajectory may be defined to facilitate passage through subsurface formations and to facilitate production. The selected trajectory may have vertical, angled and/or horizontal portions. The trajectory may be selected based on, for example, vertical and/or horizontal stresses of the formation. These stresses may be far-field stresses that result from stress applied away from the wellbore due to, for example, geological structures, such as tectonic plates.

Perforations may be performed in cased wells in order to make it possible for reservoir fluids to flow into the well. Perforations may be formed using various techniques to cut through casing, cement and/or surrounding rock. Stimulation operations, such as acid treatments and hydraulic fracturing, may also be performed to facilitate production of fluids from subsurface reservoirs.

Natural fracture networks extending through the formation also provide pathways for the flow of fluid. Man-made fractures may be created and/or natural fractures expanded to increase flow paths by injecting treatment into the formation surrounding the wellbore. Fracturing may be affected by various factors relating to the wellbore, such as the presence of casing and cement in a wellbore, open-hole completions, spacing for fracturing and/or injection, etc. Examples of fracturing are provided in U.S. Pat. No. 7,828,063.

SUMMARY

In one aspect of the present disclosure, at least one embodiment relates to a method of fracturing a subterranean formation having a wellbore therethrough. The subterranean formation has vertical and horizontal stresses applied thereto. The wellbore has a near wellbore stress zone thereabout. The method involves drilling the wellbore along a drilling path (the wellbore having a vertical portion and a horizontal portion), creating at least one 360-degree perforation in the subterranean formation about the horizontal portion of the wellbore, and fracturing the formation by injecting a fluid into the at least one 360-degree perforation.

The 360-degree perforation extends about the wellbore a distance beyond the near wellbore stress zone. The distance is at least twice a diameter of the wellbore starting from an axis of the wellbore. A direction of the 360-degree perforation is transverse to the wellbore axis. The configuration of the perforation may be defined based on the near wellbore and far-field stresses about the wellbore. The vertical and/or horizontal portion of the wellbore drilling path may be generated based on the vertical and/or horizontal stresses of the subterranean formation.

The fracturing may involve injecting hydraulic fluid comprising a viscous gel, slick water and combinations thereof and/or injecting the viscous gel and then injecting the slick water. The method may also involve isolating the wellbore about the 360-degree perforations and performing the injecting therebetween. The isolating may involve positioning bridge plugs on either side of the 360-degree perforation and defining an injection region therebetween. The creating may involve creating a plurality of 360-degree perforations along the wellbore. The creating may be performed using a jetting tool. The generating may involve generating the horizontal portion of the drilling path along a minimum horizontal stress of the formation. The wellbore may comprise casing, cement, mud and/or combinations thereof. The wellbore may be open-hole or cased-hole. The subterranean formation may be conventional and/or unconventional.

Perforations may be performed in cased wells in order to make it possible for reservoir fluids to flow into the well. Perforations may be formed using various techniques to cut through casing, cement and/or surrounding rock. Stimulation operations, such as acid treatments and hydraulic fracturing, may also be performed to facilitate production of fluids from subsurface reservoirs.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the system and method for characterizing wellbore stresses are described with reference to the following figures. The same numbers are used throughout the figures to reference like features and components.

FIGS. 1.1 and 1.2 are schematic diagrams, partially in cross-section depicting a system for fracturing a subterranean formation in accordance with an embodiment of the present disclosure;

FIGS. 2.1 through 2.3 are schematic views depicting a cross-sectional view, a partial perspective view, and an extended partial perspective view, respectively, of various portions of the wellbore and surrounding formation of FIG. 1.1 in accordance with an embodiment of the present disclosure;

FIG. 3 is schematic diagram depicting a first 3D stress configuration of a subterranean formation in accordance with an embodiment of the present disclosure;

FIGS. 4.1 through 4.3 are schematic diagrams depicting a portion of a subterranean formation with a wellbore therethrough in the stress configuration of FIG. 3 in accordance with an embodiment of the present disclosure;

FIG. 5 is a schematic diagram depicting a second 3D stress configuration of a subterranean formation in accordance with an embodiment of the present disclosure;

FIGS. 6.1 through 6.3 are schematic diagrams depicting a portion of a subterranean formation with a wellbore therethrough in the stress configuration of FIG. 5 in accordance with an embodiment of the present disclosure;

DETAILED DESCRIPTION

Figure 7:
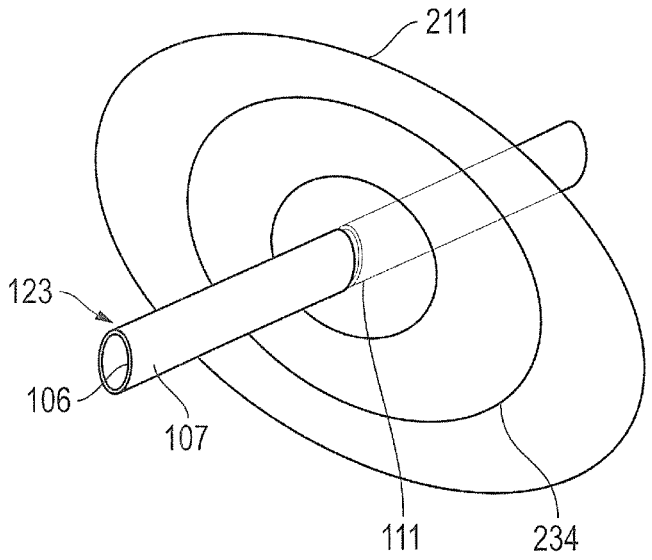
FIG. 7 is a schematic diagram depicting a perforation extended about a wellbore in accordance with an embodiment of the present disclosure.

The description that follows includes exemplary apparatuses, methods, techniques, and instruction sequences that embody techniques of the inventive subject matter. However, it is understood that the described embodiments may be practiced without these specific details.

In at least one aspect, the disclosure relates to techniques for fracturing a subterranean formation. Fracturing may involve creating perforations along one or more locations about a wellbore. Wellbore trajectory and perforation dimensions may be manipulated to facilitate fracturing, which may be based on stresses applied to the subterranean formation about the wellbore. The formation may have far-field stresses in a stress configuration where a vertical stress is greater than the horizontal stresses, or where the vertical stress is between a maximum and minimum horizontal stress. Near wellbore stresses may also be present due to, for example, drilling, cementing, casing, etc.

To facilitate fracturing under the various stress configurations, transverse perforations may be generated 360-degrees about a horizontal portion of the wellbore, and at a depth beyond a near wellbore stress zone about the wellbore. The term "perforations" as used herein comprises openings created in the wellbore, communicating the interior of the wellbore with the subterranean formation. The perforations may form a continuous opening 360-degrees about the wellbore, or may include a series of openings, radially spaced about a wellbore. Depending on the stress configuration (e.g., near wellbore and far-field stresses), perforations may be propagated in a plane at a certain orientation (inclination and azimuth) with respect to the wellbore axis. Transverse perforations may be propagated along a transverse direction (i.e., along a plane about perpendicular to the wellbore axis) about the wellbore.

FIGS. 1.1 and 1.2 illustrate a wellsite 100 with a land-based production rig 102 for producing fluid from a subterranean formation 104 via a wellbore 106. The wellbore 106 has a casing 107 therein. The production rig 102 is being stimulated to facilitate production of downhole fluids from reservoirs in the subterranean formation 104. FIG. 1.1 depicts the wellsite 100 during a perforation operation. FIG. 1.2 depicts the wellsite 100 during an injection operation.

As shown in FIG. 1.1, a wellhead 108 (and associated surface equipment) is positioned about a top end of the wellbore 106 and is connected to a service truck 110. In this example the service truck 110 is a coiled tubing unit. It includes a reel 112 with coiled tubing 114 deployed therefrom and into the wellbore 106. A perforation tool 116 is positioned at a downhole end of the coiled tubing 114. The perforation tool 116 may be a conventional stimulation tool. Examples of tools and/or system that may be used are provided in U.S. Pat. No. 7,828,063, the entire contents of which are hereby incorporated by reference herein.

In the example of FIG. 1.1, fluids are pumped through the coiled tubing 114 to the perforation tool 116. The perforation tool 116 has a perforator (e.g., water jet) 118 for creating a perforation about the wellbore 106. The perforation tool 116 may be a rotational device for rotating the water jet 118 to create a 360-degree perforation 111 about the wellbore 106. The water jet 118 or other perforation tool 116 may be configured to provide a perforation dimension sufficient to achieve the desired penetration and flow.

FIG. 1.2 shows the wellsite 100 after perforation. In this view, the rig 102 and the truck 110 have been removed. A pump system 129 is positioned about the wellhead 108 for passing fluid 125 therein through tubing 114. The downhole end of the tubing 114 has been provided with bridge plugs 122 to isolate perforated portions of the wellbore 106.

The pump system 129 is depicted as being operated by a field operator 127 for recording maintenance and operational data and/or performing maintenance in accordance with a prescribed maintenance plan. The pumping system 129 pumps the fluid 125 from the surface to the wellbore 107 during an oilfield operation.

The pump system 129 includes a plurality of water tanks 131, which feed water to a gel hydration unit 133. The gel hydration unit 133 combines water from the tanks 131 with a gelling agent to form a gel. The gel is then sent to a blender 135 where it is mixed with a proppant from a proppant transport 137 to form a fracturing fluid. The gelling agent may be used to increase the viscosity of the fracturing fluid and allows the proppant to be suspended in the fracturing fluid. It may also act as a friction reducing agent to allow higher pump rates with less frictional pressure.

The fracturing fluid 125 is then pumped from the blender 135 to the treatment trucks 120 with plunger pumps as shown by solid lines 137. Each treatment truck 120 receives the fracturing fluid at a low pressure and discharges it to a common manifold 139 (sometimes called a missile trailer or missile) at a high pressure as shown by dashed lines 141. The missile 139 then directs the fracturing fluid from the treatment trucks 120 to the wellbore 107 as shown by solid line 143. One or more treatment trucks 120 may be used to supply fracturing fluid at a desired rate.

Each treatment truck 120 may be normally operated at any rate, such as well under its maximum operating capacity. Operating the treatment trucks 120 under their operating capacity may allow for one to fail and the remaining to be run at a higher speed in order to make up for the absence of the failed pump. As shown, a computerized control system 145 may be employed to direct the entire pump system 129 during the fracturing operation.

The fluid 125 is pumped through the tubing and outlets between the bridge plugs 122. The fluid 125 may be selectively pumped into the isolated portion of the wellbore between the bridge plugs 122, and into perforations 111 to fracture in the subterranean formation 104 surrounding the wellbore 106. One or more perforations 111 may be generated at various locations along the wellbore 106.

Various fluids, such as viscous gels, may be used to create fractures. Other fluids, such as "slick water" (which may have a friction reducer (polymer) and water) may also be used to hydraulically fracture shale gas wells. Such 'slick water" may be in the form of a thin fluid (e.g., nearly the same viscosity as water) and may be used to create more complex fractures, such as multiple micro-seismic fractures detectable by monitoring.

More complexity and unexpected fracture propagation directions due to near wellbore stress concentration may be mitigated by initiating the fracturing treatment with a small volume of viscous gel (i.e., pumping a small viscous "pill"). The viscous gel may be used to effectively "plug off"

portions of the formation 104, thereby avoiding multiple fracture initiation and leaving the remaining dominant fracture to continue propagation in the desired direction.

As the viscous gel pill descends the tubing, slick water may follow to penetrate and mix with the viscous pill due to fingering. In order to facilitate the viscous pill reaching a bottom of the well with the desired properties (viscosity), the volume of the pill may be sufficient for the viscous fingering of slick water to have a desired (or limited) effect. A typical minimum volume may be, for example, 50 bbl. The maximum volume for the viscous pill may be unlimited since the entire treatment may be performed with viscous gel. By adding slick water and limiting the volume of the viscous pill, the cost of the treatment may be minimized. A typical maximum volume for the viscous pill may be, for example, about 200 bbl.

As also shown in FIGS. 1.1 and 1.2, the formation 104 has various stresses applied thereto. Such stresses include vertical stresses, such as overburden, as indicated by arrow 124. Horizontal stresses are also present as indicated by arrows 126. The horizontal stresses 126 are applied along a horizontal plane as schematically depicted. The wellbore 106 has a vertical portion 121 and a horizontal portion 123. The wellbore 106 may be defined along vertical, curved, horizontal or other paths. The path of the wellbore 106 and the shape of the perforations may be configured based on the given stresses applied to the wellbore 106 as will be discussed more fully herein.

FIGS. 2.1 and 2.2 depict the wellbore 106 and surrounding formation 104 in greater detail. FIG. 2.1 depicts a cross-sectional view of a portion of the wellbore 106. As shown in this view, the wellbore 106 has several layers thereabout extending into the subterranean formation 104. The wellbore 106 is filled with mud and has a mud cake 228 along a surface thereof created during drilling. The wellbore 106 also has a casing 107 secured therein by cement 232. FIG. 2.2 depicts a portion of the layers surrounding the wellbore 106. This view depicts a 360-degree perforation 111 extending about the wellbore 106. While a cased wellbore 106 is shown, the wellbore may optionally be open-hole (without casing or cement).

During wellbore operations (e.g., drilling, casing, cementing, etc.), a near-wellbore stress field or zone (or "drilling induced stress field") 234 is created about the wellbore. Stresses generated far away from the wellbore, or the "far-field," (e.g., due to overburden, tectonic forces, etc.) also apply. The perforations 111 and related fractures 211 may be configured to deal with the various near wellbore and far-field stresses as will be described more fully herein.

FIG. 2.3 depicts several transverse fractures 211 created along the perforations 111 of the wellbore 106. The fractures are all initiated from the locations where a 360-degree perforation 111 is cut along the casing 107 and into the formation 104 thereabout. The fractures may be created transversely about the wellbore 106 simultaneously or in sequence. The hydraulic fracturing operation may be a staged operation where fractures 211 are created one at a time in order to limit the hydraulic power used and to increase the level of control on the fracturing operation.

As also shown in FIG. 2.3, the perforation 111 is cut through the casing 107 and extends a distance into the surrounding formation 104. The perforation 111 may extend a distance beyond the near wellbore stress zone 234 and into the surrounding formation 104. In some cases, the perforation 111 may extend at least two (2D), three (3D), or a multiple n (nD) wellbore diameters, measured from the wellbore axis 109. For example, if the diameter D is about 7 inches (17.78 cm), the perforation 111 may be formed into the formation 104 up to about 14 to 21 inches (35.56 to 53.34 cm) away from the wellbore axis 109. The perforations 111 may be in the shape of longitudinal slots about the wellbore 106. The diameter D of the wellbore may be approximately equivalent to the diameter of the drill bit used to drill the portion of interest in the wellbore.

In operation, the 360-degree transverse perforation of a wellbore 106 can generate fractures 211 beyond the near wellbore stress zone 234 in a variety of stress configurations, such as those of FIGS. 3-7. In an example involving a formation 104, such as a shale gas formation, with low permeabilities (e.g., less than about 1 micro-Darcy for the horizontal permeability), the production from a well may be approximately proportional to a product of the permeability and a surface area created by the well in contact with the shale gas formation. Surface area may be increased to combat the low permeability. By creating multiple fractures along a horizontal portion of a well, an increase in the producing surface area may be generated. For example a 2,000 m (approximately 6,560 ft) long and 7-inch (17.78 cm) diameter horizontal drain with approximately 1,000 $m^2$ (approximately 10,750 $ft^2$) total surface is in direct contact with the reservoir. A single vertical hydraulic fracture may exceed 50,000 $m^2$ (approximately 537,500 ft2), accounting for both sides of the fracture (i.e., 50 times the contact surface area of the horizontal drain). A 20-stage hydraulic fracturing operation performed on a 2,000 m horizontal well can increase the initial surface area at least 1,000 fold provided the individual fractures do not overlap. Natural fractures pre-existing in the reservoir may be stimulated by the hydraulic fracturing treatment, and may contribute to further increase to the producing surface area.

Hydraulic fracturing technology may be applied to create a fracture that initiates at the wellbore and propagates deep into the rock. The "fracture initiation pressure" or "breakdown pressure" $P_{bd}$ is the minimum pressure that needs to be applied in order to start cracking the rock. This pressure depends on the stress field in the rock immediately around the wellbore, on the rock mechanical strength measured by the rock tensile strength $T_0$, and on the pressure of the fluids contained in the porosity of the rock—the so-called "pore pressure" p. The conventional formula for breakdown pressure is as follows:

$$P_{bd}=3\sigma_V-\sigma_{h\ max}+T_0-p \quad \text{(Eq. 1)}$$

Where σV is the vertical component of the stress field (i.e., the overburden pressure), and $\sigma h_{max}$ is the maximum horizontal stress. The horizontal component is the maximum horizontal stress since the horizontal well may be drilled perpendicular to the maximum horizontal stress. This formula may be applied to an open-hole horizontal well (i.e., with no casing).

In cases involving wellbores that are cased and cemented, the rock tensile strength near the wellbore may be increased in a direction parallel to the wellbore axis. This may be similar, for example, to a difference between cracking a block of plain cement and a block of cement reinforced by steel bars. To account for this near wellbore effect in the formula the rock tensile strength $T_0$ is replaced by the effective tensile strength $T_e$ff that has a higher value:

$$P_{bd}=3\sigma V\text{''}\max+T\text{eff}-p$$

A lower breakdown pressure may equate to an easier ability to crack the rock. The breakdown pressure may be produced by providing a 360-degree cut about the casing 107 in a location where the hydraulic fracture will be initiated. The 360-degree cut may be achieved by various conventional methods, such as using a mechanical rotating saw, or using a rotating jetting tool. Cutting may also be achieved using explosives, or with powerful lasers.

In some cases, maximizing well productivity may involve avoiding hydraulic fracture propagation or development along a horizontal plane. A main flowing direction for gas to reach a horizontal fracture may be vertical. For laminated sedimentary formations, such as shale gas, vertical permeability ($K_v$) may be from about 10 to about 20 times less than the horizontal permeability (Kh). In such cases, a horizontal fracture may produce from about 10 to about 20 times less gas than a vertical fracture having the same surface area.

Surface area may also be maximized by preventing hydraulic fractures from overlapping which may increase the total contact surface area proportionally to the number of fractures. Hydraulic fractures may be approximately planar, for example, in formations that are not naturally fractured and where the contrast between two horizontal principal stress components is relatively large. Rock mechanics may dictate that a direction of the fracture plane be perpendicular to the minimum principal stress direction in the rock. This direction may correspond to the easiest direction to open a crack in the rock (i.e., the direction requiring the minimum force and minimum energy). In most sedimentary basins in the world, the minimum principal stress is horizontal at the depth where oil and gas formations may be found, for example, more than about 1000 m (approximately 3,300 ft) deep. In such cases, the hydraulic fractures may develop in a vertical plane, but not always.

Overlap of fractures may be prevented by creating near parallel fractures with sufficient distance between adjacent perforations. This may be achieved by drilling a horizontal (or near horizontal) well perpendicular (or near perpendicular) to the direction of the maximum principal horizontal stress (i.e., parallel to the direction of the minimum horizontal stress).

Various additional factors may also affect maximization of fractured well productivity. The formation may be submitted to a stress field that can be represented by its three principal components (e.g., 1 vertical and 2 horizontal). The three principal stress components may have different values. When a well is drilled, the wellbore is filled with drilling mud at a certain pressure. Mud being a liquid, the stress tensor inside the well may be considered uniform (i.e., in all directions stress is equal to the drilling mud pressure). The mud pressure may be adjusted to a value high enough to avoid well collapse, and low enough to avoid fracturing the well (i.e., lower than the formation fracture pressure).

The horizontal wellbore is submitted to vertical stress (overburden) in the rock and to horizontal stress perpendicular to the wellbore axis (e.g., the maximum horizontal stress if the well is drilled perpendicular to the maximum horizontal stress direction). If the vertical and horizontal stress components have different values they may not be both cancelled out by the uniform mud pressure. Therefore, the wellbore is submitted to a net stress in one direction perpendicular to the wellbore axis. Under the action of the drill bit the wellbore may deform slightly (or strain) according to this net stress direction, which may change the stress field in the rock near the wellbore.

A hydraulic fracture may initiate in a plane that is longitudinal (i.e., a plane parallel to the wellbore axis), due to the effect of the drilling induced field. For a horizontal well a desired direction for a fracture may be transverse to the well (i.e., in a plane that is near perpendicular to a wellbore axis). The generation of fractures may depend on the stress configuration of a given formation. For example, in a first stress configuration, if a horizontal stress component of the far-field perpendicular to the wellbore axis is smaller than the vertical stress component, the initiation of the hydraulic fracture is longitudinal and in a vertical plane. In another example involving a second stress configuration, the horizontal stress component of the far-field perpendicular to the wellbore axis may be greater than the vertical stress such that initiation of the hydraulic fracture is longitudinal and in a horizontal plane.

FIGS. 3, 4.1-4.3, 5, 6.1-6.3 schematically depict example stress configurations of a formation that may apply to FIGS. 1.1 and 1.2. FIGS. 3 and 4.1-4.3 depict the first stress configuration involving a higher vertical stress than the horizontal stresses. FIGS. 5 and 6.1-6.3 depict the second stress configuration involving a vertical stress that is between maximum and minimum horizontal stresses. The stress configuration of a given formation may be a function of the geological structure (e.g., tectonic plates) of the subterranean formation 104. A trajectory of the wellbore 106 and a configuration of fractures 211 and perforations 111 may be selected based on the stress configuration of a given situation.

FIG. 3 shows a 3D stress model 300 of a subterranean formation 104 having a vertical stress (or overburden) along the y-axis as indicated by arrow 336. A maximum horizontal stress is applied along the x-axis as indicated by arrows 338.1 and a minimum horizontal stress is applied along the y-axis as indicated by arrows 338.2. In this case, the vertical stress $\sigma_v$ has a higher value than the minimum horizontal stress $\sigma_h$ min and the maximum horizontal stress $\sigma_h$ max. The horizontal stresses may be different (e.g., $\sigma_h$ min$<\sigma_h$ max).

A wellbore 106 is depicted as extending through the subterranean formation 104. The vertical portion 121 of the wellbore 106 is positioned along the vertical stress 336. The horizontal portion 123 of the wellbore 106 is positioned along the minimum horizontal stress 338.2. Perforations 111 extend about the horizontal portion 123 of the wellbore 106 in the direction of maximum horizontal stress 338.1.

In the first configuration, and assuming a horizontal well was drilled perpendicular to the maximum horizontal stress, the hydraulic fracture expands under the effect of pumping hydraulic fluids along the initiation direction until it reaches a zone where the near wellbore stress is no longer effective (beyond 2 or 3 wellbore diameters depending on the formation types and stresses applied). Beyond that zone the hydraulic fracture plane rotates to gradually line up in a direction perpendicular to the far-field minimum horizontal stress, i.e., transverse to the well which is the desired direction for best hydrocarbon productivity.

FIGS. 4.1 through 4.3 schematically depict the stress model 300 about the wellbore 106 with the 360-degree perforations 111 therein and fractures 211 extending therefrom. The wellbore 106 has the casing 107 and the near wellbore stress zone 234 thereabout. FIG. 4.1 depicts a vertical portion 121 of the wellbore 106 and the subterranean formation 104 thereabout. In this figure, the fracture is longitudinal and the fracture plane is oriented perpendicular to the minimum horizontal stress direction.

FIGS. 4.2 and 4.3 depict a horizontal portion 123 of the wellbore 106 and the subterranean formation 104 thereabout. The wellbore 106 extends into the formation 104 perpendicular to the maximum horizontal stress. As shown in FIGS. 4.2 and 4.3, the perforation 111 is provided in a direction parallel to a wellbore axis 109 and along the y-axis or minimum horizontal stress. Near wellbore stresses within zone 234 may induce stresses that cause the hydraulic fracture to initiate in a longitudinal plane parallel to the y-axis of the wellbore 106.

The fracture 211 continues to extend into the extended region 442 as shown in FIG. 4.3. The extended region 442 extends through the formation and beyond the near wellbore stress zone 234. The hydraulic fracture expands into the formation 104 after longitudinal initiation shown in FIG. 4.2. When the fracture reaches beyond the near wellbore stress zone 234, the fracture rotates until the fracture plane is perpendicular to the minimum horizontal stress direction. This schematic shows that the hydraulic conductivity of this fracture may be limited due to the complexity of the connection between the fracture and the casing 107.

FIG. 5 shows a 3D stress model 500 of a subterranean formation having a vertical stress (or overburden) along the z-axis as indicated by arrow 536. The stress configuration of FIG. 5 may be encountered, for example, in shale gas formations of the Sichuan basin in China. The far-field stresses may be, for example, σh max=55 MPa, σh min=29 MPa, and $\sigma_v$=35 MPa at 1500 m true vertical depth (TVD). The formation 104 is submitted to a maximum horizontal stress along the x-axis as indicated by arrows 538.1 and to a minimum horizontal stress along the y-axis as indicated by arrows 538.2. In this case, the vertical stress $\sigma_v$ has a value between that of the minimum horizontal stress σh min and the maximum horizontal stress σh max. The horizontal stresses may be different (e.g., σh min<

In the second configuration, again assuming the horizontal well was drilled perpendicular to the maximum horizontal stress, the hydraulic fracture also expands along the initiation direction (i.e., in a horizontal plane) until it reaches the far-field zone. What happens next to the fracture plane direction depends on the formation properties and the actual stress field component values. Even when the minimum stress is horizontal, the hydraulic fracture may keep developing horizontally following the formation laminations. For the fracture to rotate from horizontal to vertical despite sedimentary laminations may require a contrast large enough (e.g., more than 25%) between the minimum horizontal stress and the overburden.

FIG. 6.1 through 6.3 schematically depict the effects of the stresses of stress model 500 on the wellbore 106 with the 360-degree perforation 111 therein. FIG. 6.1 depicts a vertical portion 121 of the wellbore 106 and the subterranean formation 104 thereabout. In this figure, the fracture 211 is longitudinal and the fracture plane is oriented perpendicular to the minimum horizontal stress direction.

FIGS. 6.2 and 6.3 depict a horizontal portion 123 of the wellbore 106 and the subterranean formation 104 thereabout. As shown in FIG. 6.2, the perforation 111 is provided in a direction transverse to the wellbore 106 and along the x-axis or maximum horizontal stress. FIG. 6.2 shows how a hydraulic fracture initiates from a horizontal well 106 in the stress model 500 and with the same stress configuration shown in FIG. 5.

The fracture 211 of FIG. 6.2 is longitudinal and in a horizontal plane that corresponds to the direction perpendicular to the maximum horizontal stress (i.e., the maximum component of the stress field perpendicular to the y-axis of the wellbore 106). If the difference between the vertical stress and the minimum horizontal stress is not large enough, the fracture may keep expanding in a horizontal plane or to follow the general direction of rock laminations that may be close to horizontal. This may be, for example, the configuration as shown in FIGS. 4.2 and 4.3 where the ratio $\sigma_v$/σh min is greater than 1.

FIG. 6.3 shows the initiation of a transverse hydraulic fracture 211 from a horizontal portion 123 of wellbore 106 drilled in the stress model 500 with the same stress configurations as shown in FIG. 3 or 5. In both stress field configurations, the fracture initiates in a transverse plane. The fracture initiates from the 360-degree perforation in the casing 107 with hole penetration beyond the drilling induced stress zone 234. Thus, the 360-degree transverse perforation provides a transverse and vertical fracture in either stress configuration. The perforation 111 may expand about the wellbore 106 as shown in FIG. 7 to generate a clean connection between the fracture plane and the casing 107.

Figure 8:
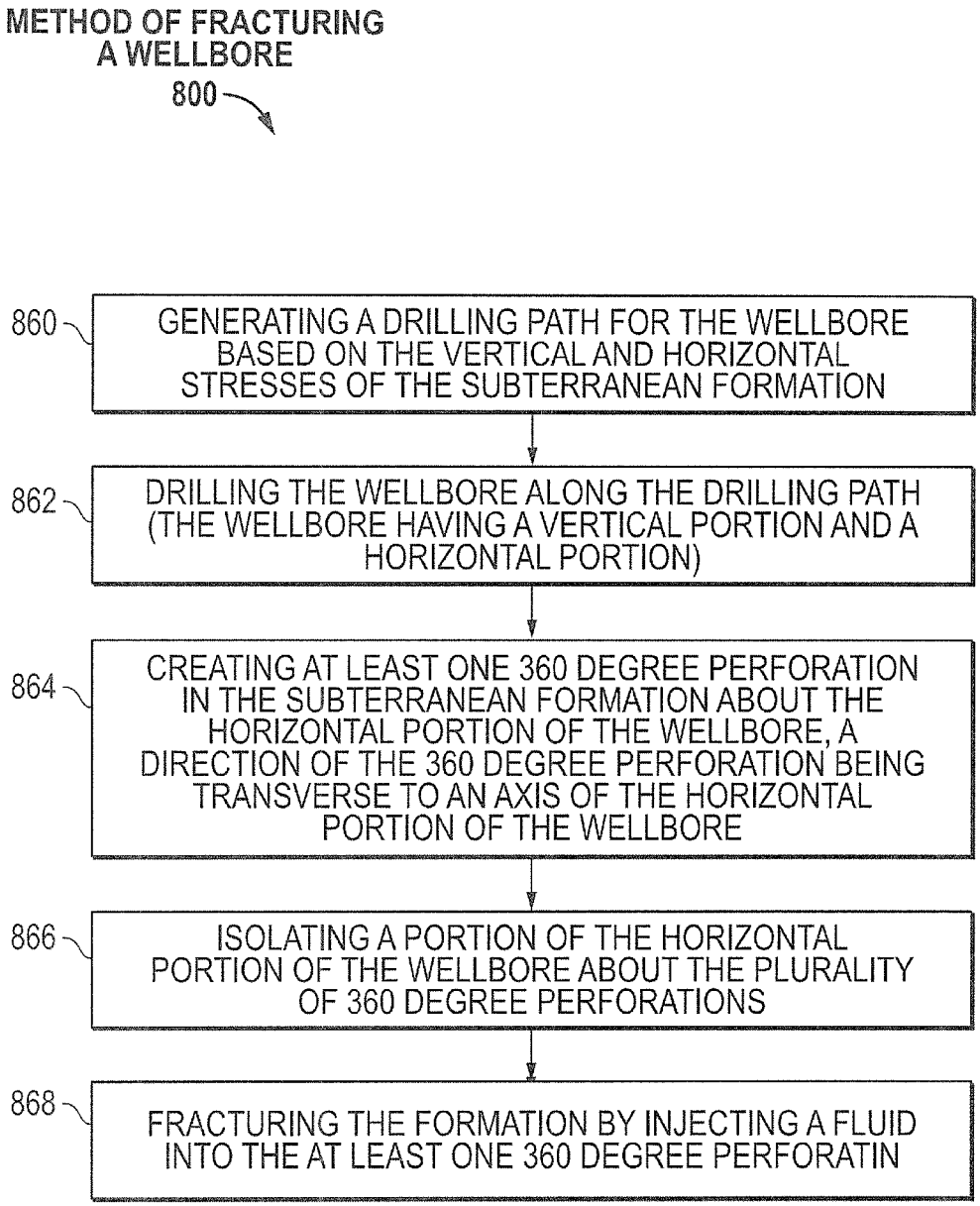
FIG. 8 is a flow chart depicting a method for fracturing a subterranean formation in accordance with an embodiment of the present disclosure.

FIG. 8 depicts a method 800 of fracturing a wellbore. The method may involve 860—generating a drilling path for the wellbore based on the vertical and horizontal stresses of the subterranean formation, 862—drilling the wellbore along the drilling path (the wellbore having a vertical portion and a horizontal portion), 864—creating at least one 360-degree perforation in the subterranean formation about the horizontal portion of the wellbore (a direction of the 360-degree perforation being transverse to an axis of the horizontal portion of the wellbore), 866—isolating a portion of the horizontal portion of the wellbore about the plurality of 360-degree perforations, and 868—fracturing the formation by injecting a fluid into the at least one 360-degree perforation.

The perforation may be created using a jetting tool or a laser tool. The method may also involve generating a perforation plan based on the near wellbore stress zone and the horizontal and vertical stresses. The generating may involve defining a configuration of the plurality of 360-degree perforations. The configuration may be the shape, location, angle, depth, and/or width. The generating may also involve determining breakdown pressure, pore pressure and rock tensile strength. The method may be performed in any order and repeated as desired.

Although only a few example embodiments have been described in detail above, those skilled in the art will readily appreciate that many modifications are possible in the example embodiments without materially departing from the system and method for performing wellbore stimulation operations. For example, while a land-based production rig 102 is shown in at least one embodiment herein, it should be understood that an offshore based production rig may also be used for producing fluid from a subterranean formation. Moreover, while the service truck 110 is shown as a coiled tubing unit, it should be understood that a wireline unit, or the like, may also be used to create perforations in or about the wellbore. Accordingly, all such modifications are intended to be included within the scope of this disclosure as defined in the following claims.

What is claimed is:

1. A method of fracturing a subterranean formation having a wellbore therethrough, the subterranean formation having vertical and horizontal stresses applied thereto, the wellbore having a near wellbore stress zone thereabout, the method comprising:

drilling the wellbore along a drilling path, the wellbore having a vertical portion and a horizontal portion;

creating at least one 360-degree perforation in the subterranean formation about the horizontal portion of the wellbore, the at least one 360-degree perforation extending about the wellbore a distance beyond the near wellbore stress zone, the distance being at least twice a diameter of the wellbore starting from an axis of the wellbore, a direction of the 360-degree perforation being transverse to the axis of the wellbore; and fracturing the formation by injecting a fluid into the at least one 360-degree perforation.

2. The method of claim 1, wherein the fracturing comprises injecting hydraulic fluid comprising a viscous gel, slick water and combinations thereof.

3. The method of claim 2, wherein the fracturing comprises injecting the viscous gel and then injecting the slick water.

4. The method of claim 1, further comprising isolating the wellbore about the at least one 360-degree perforation and performing the injecting therebetween.

5. The method of claim 4, wherein the isolating comprises positioning bridge plugs on either side of the at least one 360-degree perforation and defining an injection region therebetween.

6. The method of claim 1, further comprising generating a drilling path for the wellbore based on the vertical and horizontal stresses of the subterranean formation.

7. The method of claim 6, wherein the generating further comprises generating the drilling path of the horizontal portion of the wellbore along a minimum horizontal stress of the formation.

8. The method of claim 1, wherein the distance beyond the near wellbore stress zone being a multiple n (nD) wellbore diameters measured from the axis of the wellbore, wherein n is at least twice the diameter of the wellbore.

9. The method of claim 1, wherein the creating comprises creating a plurality of 360-degree perforations along the wellbore.

10. The method of claim 1, wherein the creating is performed using one of a jetting tool and a laser tool.

11. The method of claim 1, wherein the wellbore is at least one of casing, cement, mud and combinations thereof.

12. The method of claim 1, wherein the wellbore is at least one of open-hole or cased-hole.

13. The method of claim 1, wherein the subterranean formation is one of conventional, unconventional and combinations thereof.

14. A method of fracturing a subterranean formation having a wellbore therethrough, the subterranean formation having vertical and horizontal stresses applied thereto, the wellbore having a near wellbore stress zone thereabout, the method comprising:

generating a drilling path for the wellbore based on the vertical and horizontal stresses of the subterranean formation;

drilling the wellbore along the drilling path, the wellbore having a vertical portion and a horizontal portion;

creating at least one 360-degree perforation in the subterranean formation about the horizontal portion of the wellbore, the at least one 360-degree perforation extending about the wellbore a distance beyond the near wellbore stress zone; and fracturing the formation by injecting a fluid into the at least one 360-degree perforation, the fluid comprising a viscous gel and slick water.

15. The method of claim 14, wherein the fracturing comprises fracturing the formation by injecting the viscous gel and then the slick water into the at least one 360-degree perforation.

16. The method of claim 14, further comprising generating a perforation plan based on the near wellbore stress zone and the horizontal and vertical stresses.

17. The method of claim 16, wherein the generating comprises defining a configuration of the plurality of 360-degree perforations.

18. The method of claim 17, wherein the configuration comprises one of shape, location, angle, depth, width, and combinations thereof.

19. The method of claim 16, wherein the generating comprises determining breakdown pressure, pore pressure and rock tensile strength.

20. A method of fracturing a subterranean formation having a wellbore therethrough, the subterranean formation having vertical and horizontal stresses applied thereto, the wellbore having a near wellbore stress zone thereabout, the method comprising:

generating a drilling path for the wellbore based on the vertical and horizontal stresses of the subterranean formation;

drilling the wellbore along the drilling path, the wellbore having a vertical portion and a horizontal portion;

creating a plurality of 360-degree perforations in the subterranean formation about the horizontal portion of the wellbore, the plurality of 360-degree perforations extending about the wellbore a distance beyond the near wellbore stress zone;

isolating a portion of the horizontal portion of the wellbore about the plurality of 360-degree perforations; and fracturing the formation by injecting a fluid into the at least one 360-degree perforation.

21. The method of claim 20, wherein the isolating comprises positioning bridge plugs about the portion of the horizontal portion of the wellbore.

* * * * *